US005703954A

United States Patent [19]

Dapper et al.

[11] Patent Number: 5,703,954

[45] Date of Patent: Dec. 30, 1997

[54] METHOD AND APPARATUS FOR IMPROVING THE QUALITY OF AM COMPATIBLE DIGITAL BROADCAST SYSTEM SIGNALS IN THE PRESENCE OF DISTORTION

[75] Inventors: Mark J. Dapper, Cincinnati; Barry W. Carlin, Greenhills; Michael J. Geile, Loveland, all of Ohio

[73] Assignee: USA Digital Radio Partners, L.P., New York, N.Y.

[21] Appl. No.: 604,199

[22] Filed: Feb. 20, 1996

[51] Int. Cl.[6] ..... H04H 5/00

[52] U.S. Cl. ..... 381/15; 381/1; 381/10; 381/13; 381/94.1

[58] Field of Search ..... 381/10, 11, 13, 381/15, 1, 2, 94, 106, 107

[56] References Cited

U.S. PATENT DOCUMENTS

| | | | |
|---|---|---|---|
| 3,160,812 | 12/1964 | Scantlin | 325/30 |
| 3,714,375 | 1/1973 | Stover | 179/2 |
| 4,323,731 | 4/1982 | Hershberger | 179/2 |
| 4,379,947 | 4/1983 | Warner | 179/2 |
| 4,512,013 | 4/1985 | Nash et al. | 370/69 |
| 4,550,415 | 10/1985 | Debus, Jr. et al. | 375/14 |
| 4,843,583 | 6/1989 | White et al. | 354/724 |
| 4,847,797 | 7/1989 | Picchi et al. | 364/602 |
| 5,006,926 | 4/1991 | Tsinberg | 358/12 |
| 5,113,142 | 5/1992 | Yoshikawa | 329/306 |
| 5,146,612 | 9/1992 | Grosjean et al. | 455/45 |
| 5,175,747 | 12/1992 | Murakami | 375/14 |
| 5,191,576 | 3/1993 | Pommier et al. | 370/18 |
| 5,214,671 | 5/1993 | Nakai | 375/14 |
| 5,243,624 | 9/1993 | Paik et al. | 375/14 |
| 5,268,930 | 12/1993 | Sendyk et al. | 375/13 |
| 5,351,148 | 9/1994 | Maeda et al. | 359/124 |
| 5,448,590 | 9/1995 | Kostic | 375/232 |

*Primary Examiner*—Curtis Kuntz
*Assistant Examiner*—Duc Nguyen

[57] ABSTRACT

A system and method are provided for reducing perceived distortion in an output audio signal derived from an amplitude modulated compatible digital broadcast signal having a monophonic portion and a stereo portion. The stereo portion of this signal is demodulated to produce a demodulated stereo signal and the monophonic portion of the signal is demodulated to produce a demodulated monophonic signal. The noise in the demodulated stereo signal is measured and an estimate of the signal-to-noise ratio is derived. This estimated signal-to-noise ratio is compared with a threshold level which is set at the minimum acceptable signal quality for the stereo signal. Based upon the estimated signal-to-noise ratio, a switch directs either the monophonic derived audio output or the stereo derived audio output as the system output signal.

14 Claims, 1 Drawing Sheet

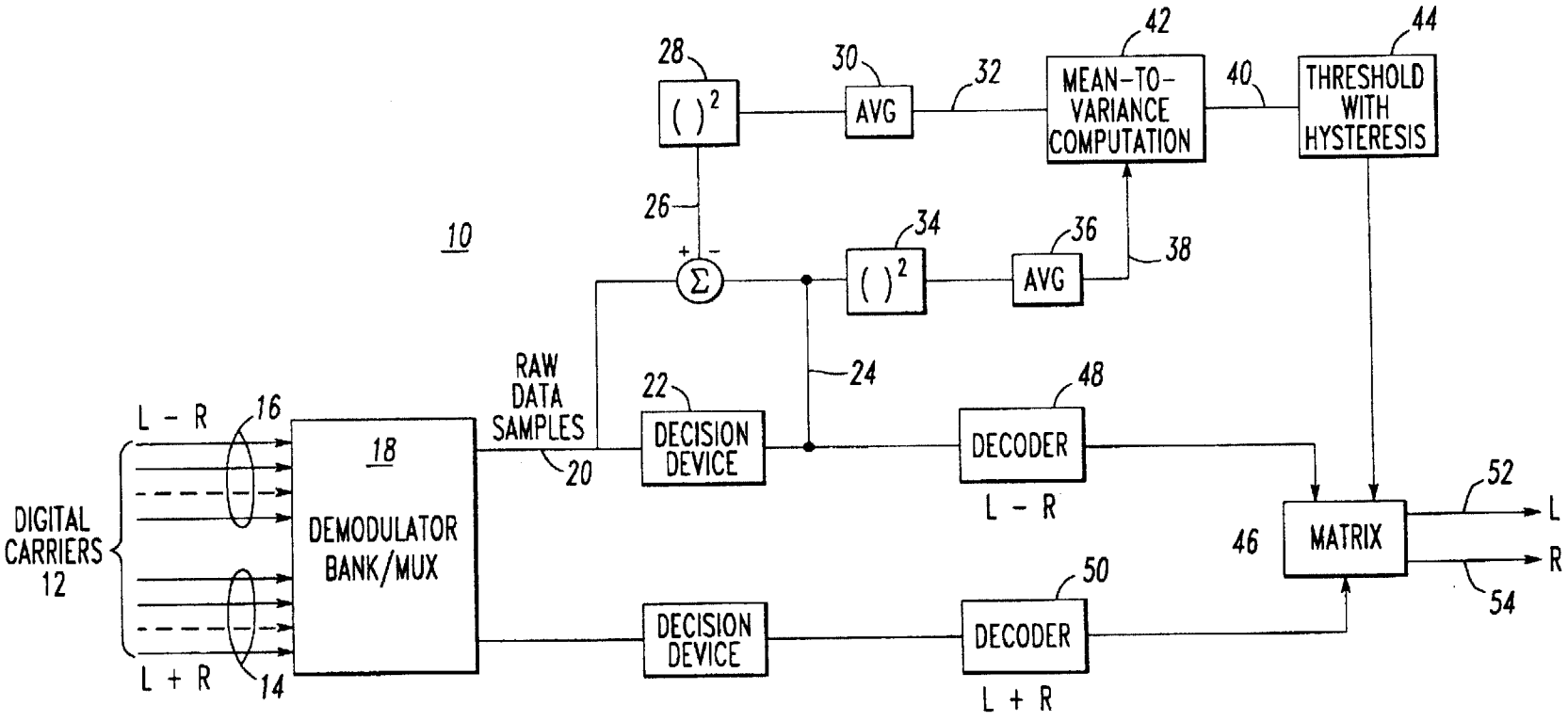
THRESHOLD WITH HYSTERESIS
MEAN-TO-VARIANCE COMPUTATION
AVG
AVG
( )²
( )²
Σ
DECISION DEVICE
DECISION DEVICE
DECODER
L - R
DECODER
L + R
MATRIX
L
R
RAW DATA SAMPLES
DEMODULATOR BANK/MUX
L - R
L + R
DIGITAL CARRIERS 12
10
18
14
16
20
22
24
26
28
30
32
34
36
38
40
42
44
46
48
50
52
54

METHOD AND APPARATUS FOR IMPROVING THE QUALITY OF AM COMPATIBLE DIGITAL BROADCAST SYSTEM SIGNALS IN THE PRESENCE OF DISTORTION

BACKGROUND OF THE INVENTION

1. Field of the Invention

This invention relates to radio broadcasting and, more particularly, to methods of and apparatus for improving the quality of an amplitude modulated compatible digital broadcast signal in the presence of distortion.

2. Description of Related Art

There has been increasing interest in the possibility of broadcasting digitally encoded audio signals to provide improved audio fidelity. Several approaches have been suggested. One such approach, set forth in copending patent application Ser. No. 08/206,368, filed Mar. 7, 1994, assigned to the assignee hereof, teaches a method for simultaneously broadcasting analog and digital signals in a standard AM broadcasting channel. An amplitude modulated radio frequency signal having a first frequency spectrum is broadcast.

The amplitude modulated radio frequency signal includes a first carrier modulated by an analog program signal. Simultaneously, a plurality of digitally modulated carrier signals are broadcast within a bandwidth which encompasses the first frequency spectrum. Each of the digitally modulated carrier signals is modulated by a portion of a digital program signal. A first group of the digitally modulated carrier signals lies within the first frequency spectrum and is modulated in quadrature with the first carrier signal. Second and third groups of the digitally modulated carrier signals lie outside of the first frequency spectrum and are modulated both in-phase and in-quadrature with the first carrier signal. Both transmitters and receivers are provided in accordance with that method.

The waveform in the AM compatible digital audio broadcasting system described in U.S. patent application Ser. No. 08/206,368, filed Mar. 7, 1994, hereby incorporated herein by reference, has been formulated to employ multiple digital carriers to carry a composite data rate suitable for high quality audio reproduction. These digital carriers are placed in such a fashion that some carriers are inherently more susceptible to interference than other carriers. For example, when audio stereo information is allocated to a digital signal in a manner in which stereo information, i.e., left-right (l–r), is separable from monophonic information, i.e., left-right (l+r), the monophonic information is generally inherently more reliable than the stereo information. In order to fully utilize the stereo information, there is a need for a system which reduces the perceived distortion in digital audio broadcast systems at low signal-to-noise ratios or in the presence of interference from other broadcasting stations.

U.S. Pat. No. 4,159,396 discloses an AM stereo receiver having a signal-controlled corrector in which a signal level controlled switching circuit removes the stereo correction factor in a compatible AM stereo receiver when the received signal level is low enough to allow signal degradation due to noise affecting the correction factor. The switching circuit can operate on either an instantaneous or an average signal level.

U.S. Pat. No. 4,169,968 discloses a noise protection circuit for AM stereo cosine correction factor. The cosine correction factor of a receiver for compatible AM stereo reception is controlled by the amount of high frequency energy present in the demodulated signal. Large amounts of such energy indicate a low signal-to-noise ratio and cosine correction under such conditions is not desirable. During periods of excessive high frequency energy, a filter circuit output causes a switching circuit to remove the derived cosine correction factor and cause division of the demodulated signal by a factor of one instead.

Neither system above is adapted to reduce distortion in an AM compatible digital audio broadcasting system whereby in the presence of high interference or low signal-to-noise ratio, only the monophonic portion of the digital signal can be used. As a result, there is a need for a method and apparatus for reducing perceived distortion in an AM compatible digital audio broadcasting system whereby in the presence of high interference or low signal-to-noise ratio, only the monophonic portion of the digital signal can be used.

SUMMARY OF THE INVENTION

A system for reducing perceived distortion in an output audio signal derived from an amplitude modulated compatible digital broadcast signal is provided. The digital broadcast signal has a monophonic portion and a stereo portion. The system includes means for demodulating the stereo portion of the signal to produce a demodulated stereo signal. Likewise, the system includes means for demodulating the monophonic portion of the signal to produce a demodulated monophonic signal. The system measures the noise in the demodulated stereo signal and compares the noise to a threshold level set at a minimum acceptable signal quality. A switching means is provided in the system to select either the demodulated stereo signal or the demodulated monophonic signal as the output audio signal. The switch will send as the output audio signal the demodulated stereo signal as long as the noise in the demodulated stereo signal is at or better than the threshold level for minimum acceptable signal quality.

BRIEF DESCRIPTION OF THE DRAWINGS

The invention will be more readily apparent to those skilled in the art by reference to the accompanying drawings wherein:

FIG. 1 is a block diagram of a presently preferred embodiment of the apparatus for improving the quality of AM compatible digital broadcast signals of the present invention.

DETAILED DESCRIPTION OF THE PREFERRED EMBODIMENTS

The system 10 of the present invention is illustrated in FIG. 1. Therein, a composite digital signal 12 is provided having multiple data carrier signals. Among these multiple data carrier signals are monophonic signal carriers 14 and stereo signal carriers 16. Composite digital signal 12 is applied to demodulator 18 which produces raw or noisy data samples for each group of carriers 14 and 16. In general, these samples are corrupted by noise and/or interference. The data is assigned to the carriers such that the monophonic L+R digital signals 14 are more resistant to noise and interference than the stereo L–R digital signals 16.

Demodulator 18 produces samples 20 of the stereo signal carries 16 which are corrupted by noise or interference. The noisy symbols 20 are applied to a decision device 22 which produces a data symbol estimate based on the noisy demodulator samples 20. This data estimate can include an arbitrary number of symbols provided the symbol set is of a finite size. In the presently preferred embodiment of system 10, this decision is based upon minimum Euclidean distance. However, other metrics, such as Hamming distance in a coded system, are possible.

The output 24 of decision device 22 consists of a sequence of data symbols which are subtracted from the noisy input samples 20 to decision device 22 to produce an error estimate 26. This error estimate 26 is squared in operation 28 to remove the error polarity information. After squaring, the error sequence is filtered or averaged in operation 30. This filtered error sequence is now proportional to the variance of the noisy data samples 20. By definition, this renders the noise or interference power 32.

Similarly, the output 24 of decision device 22 is squared in operation 34 and again averaged or filtered in operation 36. This sequence is then proportional to the mean square value of the data signal 16. By definition, this renders the signal power 38. Alternatively, signal 20 may be used in a similar manner to determine the signal power.

Using the signal power 38 and noise power 32, an estimate of the stereo channel signal-to-noise ratio 40 can be produced by computing the ratio of the mean squared symbol estimate 38 to the variance of the error sequence 32 in operation 42. For symbol error rates of interest (below 10%), there is little loss in accuracy due to symbol errors.

The squaring, averaging, and ratio operations discussed above can be replaced by other operations which also yield a monotonic variation in some quantity as a function of the mean variance of the symbol samples. As an example, the squaring operation can be replaced by an absolute value operation.

The estimated signal-to-noise ratio 40 is applied to a threshold detector 44 which is set to operate at the boundary between the region in which the demodulated symbols support acceptable digital audio quality and the region in which the error rate is too large to support acceptable quality. The threshold detector 44 incorporates hysteresis so that the decision does not oscillate rapidly when the detected signal-to-noise ratio 40 is close to the threshold setting.

The threshold detector 44 is used to control a stereo matrix circuit or computation 46. The inputs to stereo matrix circuit 46 are decoded stereo signal 16 and decoded monophonic signal 14, each having passed through decoders 48 and 50, respectively. Decoders 48 and 50 may each incorporate a digital-to-analog converter so that they provide analog outputs. Alternatively, the decoders may output digital signals that are converted to analog by stereo matrix circuit 46 or by a circuit provided thereafter. Stereo matrix circuit 46 uses the results of threshold detector 44 to synthesize discrete left stereo output 52 and right stereo output 54 from the addition and subtraction of the L–R stereo carriers 16 and L+R monophonic carriers 14 inputs.

If desired, a gradual transition from stereo to monophonic conditions can be effected by replacing the threshold detector 44 and stereo matrix 46 with a circuit or computation which gradually reduces stereo separation as a function of the measured signal-to-noise ratio 40. Such a circuit or computation, which is selected from those well known by those skilled in the art, controls the relative blend of the L+R monophonic carriers 16 and L–R stereo carriers 14 signals.

In the foregoing specification certain preferred practices and embodiments of this invention have been set out, however, it will be understood that the invention may be otherwise embodied within the scope of the following claims.

We claim:

1. A system for reducing perceived distortion in an output audio signal derived from an amplitude modulated compatible digital broadcast signal having a monophonic portion and a stereo portion, said system comprising:

(a) means for demodulation said monophonic portion of said signal to produce a demodulated monophonic signal;

(b) means for demodulation said stereo portion of said signal to produce a demodulated stereo signal having a signal-to-noise ratio;

(c) means for estimation the signal-noise ratio in the demodulated stereo signal, said means for estimating the signal-noise ratio in the demodulated stereo signal comprising means for estimating the noise in the demodulated stereo signal, means for estimating the power of the demodulated stereo signal, and means for dividing the estimated noise in the demodulated stereo signal into the estimated power of the demodulated stereo signal, wherein said means for estimating the noise in the demodulated stereo signal comprises means for subtracting the demodulated stereo signal from said stereo portion of said amplitude modulated compatible digital broadcasting signal to obtain an error estimate, means for squaring said error estimate, and means for averaging said squared error estimate;

(d) means for comparing the estimated signal-to-noise ratio in the demodulated stereo signal to a threshold level set at the minimum acceptable signal quality; and (e) means responsive to said means for comparing for synthesizing discrete left and right stereo outputs.

2. The system of claim 1 further comprising:

(f) means for decoding said demodulated monophonic signal into a first signal; and (g) means for decoding said demodulated stereo signal into a second signal, wherein said first and second signals are inputs to said means for synthesizing discrete left and right stereo outputs.

3. The system of claim 1 wherein said first and second signals are analog signals.

4. The system of claim 1 wherein said means for synthesizing discrete left and right stereo outputs includes means for combining relative portions of said first and second analog signals in response to said means for comparing.

5. The system of claim 1 wherein said means for estimating the power of the demodulated stereo signal comprises means for squaring the demodulated stereo signal and means for averaging said squared signal.

6. The system of claim 1 wherein said means for estimating the signal-to-noise ratio in the demodulated stereo signal detects a monotonic variation in a quantity of said demodulated stereo signal as a function of the mean and variance of said quantity.

7. The system of claim 1 wherein said means for synthesizing discrete left and right stereo outputs operates by employing hysteresis.

8. A method for reducing perceived distortion in an output audio signal derived from an amplitude modulated compatible digital broadcast signal having a monophonic portion and a stereo portion comprising the steps of:

(a) demodulating said monophonic portion of said signal to produce a demodulated monophonic signal;

(b) demodulating said stereo portion of said signal to produce a demodulated stereo signal having a signal-to-noise ratio;

(c) estimating the signal-to noise ratio in the demodulated stereo signal by estimating the power of the demodulated stereo signal, and dividing the estimated noise in the demodulated stereo signal into the estimated power of the demodulated stereo signal, wherein the noise in the demodulated stereo signal is estimated by subtracting the demodulated stereo signal from said stereo portion of said amplitude modulated compatible digital broadcasting signal to obtain an error estimate, squaring said error estimate,and averaging said squared error estimate;

(d) comparing the estimated signal-to-noise ratio in the demodulated stereo signal to a threshold level set at the minimum acceptable signal quality; and (e) synthesizing discrete left and right stereo outputs in response to said comparison of the estimated signal-to-noise ratio in the demodulated stereo signal to a threshold level set at the minimum acceptable signal quality.

9. The method of claim 8 further comprising the steps of:

(f) decoding said demodulated monophonic signal into a first signal; and (g) decoding said demodulated stereo signal into a second signal, wherein said first and second signals are input to synthesize said discrete left and right stereo outputs.

10. The method of claim 8 wherein said first and second signals are analog signals.

11. The method of claim 8 wherein relative portions of said first and second analog signals are combined to synthesize said discrete left and right stereo outputs includes means in response to the comparison of the estimated signal-to-noise ratio in the demodulated stereo signal to a threshold level set at the minimum acceptable signal quality.

12. The method of claim 8 wherein the step of estimating the power of the demodulated stereo signal comprises the steps of squaring the demodulated stereo signal and averaging said squared signal.

13. The method of claim 8 wherein the step of the signal-to-noise ratio in the demodulated stereo signal comprises the step of detecting a monotonic variation in a quantity of said demodulated stereo signal as a function of the mean and variance of said quantity.

14. The method of claim 8 wherein the step of synthesizing discrete left and right stereo outputs operates by employing hysteresis.

* * * * *